United States Patent [19]

Baer

[11] Patent Number: 4,836,501

[45] Date of Patent: Jun. 6, 1989

[54] STRUCTURE LEVELING DEVICE

[76] Inventor: William F. Baer, 1509 N. Darcy St., Simi Valley, Calif. 93065

[21] Appl. No.: 215,392

[22] Filed: Jul. 5, 1988

[51] Int. Cl.[4] ..... E02C 3/00

[52] U.S. Cl. ..... 254/88

[58] Field of Search ..... 254/88, 104, 5 R, 5 B, 254/5 C, 90; 182/107, 108, 109; 14/69.5, 71.1; 248/188.2, 346, 352

[56] References Cited

U.S. PATENT DOCUMENTS

| | | | |
|---|---|---|---|
| 2,450,648 | 10/1948 | Felzer | 254/88 |
| 3,630,487 | 12/1971 | Wechter | 254/88 |
| 3,752,441 | 8/1973 | Rogers | 254/88 |
| 3,993,275 | 11/1976 | Lucas | 182/107 |
| 4,103,870 | 8/1978 | Murakami | 254/88 |

*Primary Examiner*—Robert C. Watson

*Attorney, Agent, or Firm*—Jack C. Munro

[57] ABSTRACT

A structure leveling device designed primarily to be utilized for recreational vehicles which is constructed of an integral plastic member having an upper surface which is divided into a plurality of levels of different heights. This structure leveling device is constructed in a manner to safely support the weight of a vehicle. Also, the device is constructed to facilitate movement of a vehicle wheel onto the different levels. Also, the upper surface of each of the levels includes a roughened anti-skid surface.

1 Claim, 1 Drawing Sheet

STRUCTURE LEVELING DEVICE

BACKGROUND OF THE INVENTION

The field of this invention relates to leveling devices and more particularly to a structure leveling device which is designed primarily to be used in conjunction with a vehicle such as a recreational vehicle.

When operating recreational vehicles, it is usual for the operators to stop for a given period of time such as within a campground or the like. At times, stopping may be only overnight, and at other times may be for a plurality of days. Many times the location that is selected for stopping is on terrain that is not precisely level. If the terrain is not level, the floor of the recreational vehicle is also not level. When human beings are moving across the floor and the floor is not level, it is an uncomfortable situation. Also, many of the recreational vehicles include refrigerators. It is required for correct refrigerator operation that the refrigerator be maintained level.

Therefore, there has long been a need to utilize a leveling device in conjunction with a recreational vehicle. Common versions of this leveling device would be pieces of wood, cement blocks, bricks or the like. Also, it has been common to utilize some form of a jack. However, the jack is an expensive form of leveling device and also requires some operation in order to locate the recreational vehicle at a level position. Also, there is a possibility that the vehicle could be disengaged from the jack accidentally, such as by the wind.

SUMMARY OF THE INVENTION

The structure leveling device of this invention constitutes a single integral plastic molded unit which has a flat bottom surface which is adapted to set on a supporting surface such as the ground, and an upper surface which is formed into a plurality of different flat levels, each level being of a different height relative to the bottom surface of the leveling device. An inclined ramp is formed between each directly adjacent pair of levels and also at the front edge of the device to facilitate movement of a tire of a vehicle onto each level. The side walls of the leveling device are profoundly corrugated in essence forming a rib configuration with this corrugation being for the purpose of increasing the compressive strength of the leveling device. Also, the leveling device is hollow and within this hollow chamber is formed a cross-brace arrangement, again, for increasing a compressive strength characteristic of the device. The entire upper surface is hiatused to form a roughened surface to resist accidental slipping of the vehicle tire from the device.

The primary objective of the present invention is to construct a single compact unit which is to be associated with a wheel of a vehicle to raise a portion of the vehicle to thereby locate the bed of the vehicle at a level position.

Another objective of the present invention is to construct a device which can be molded as a single unit, manufactured inexpensively, and therefore be sold to the ultimate consumer at an inexpensive price.

Another objective of this invention is to construct a single integral unit which is constructed to be of substantial high strength and will not permit the vehicle to be accidentally disengaged from the leveling device.

Another objective of this invention is to construct a leveling device so that it can be operated easily by even relatively unskilled individuals where the vehicle can just be merely driven onto the leveling device.

DETAILED DESCRIPTION OF THE SHOWN EMBODIMENT

Figure 1:
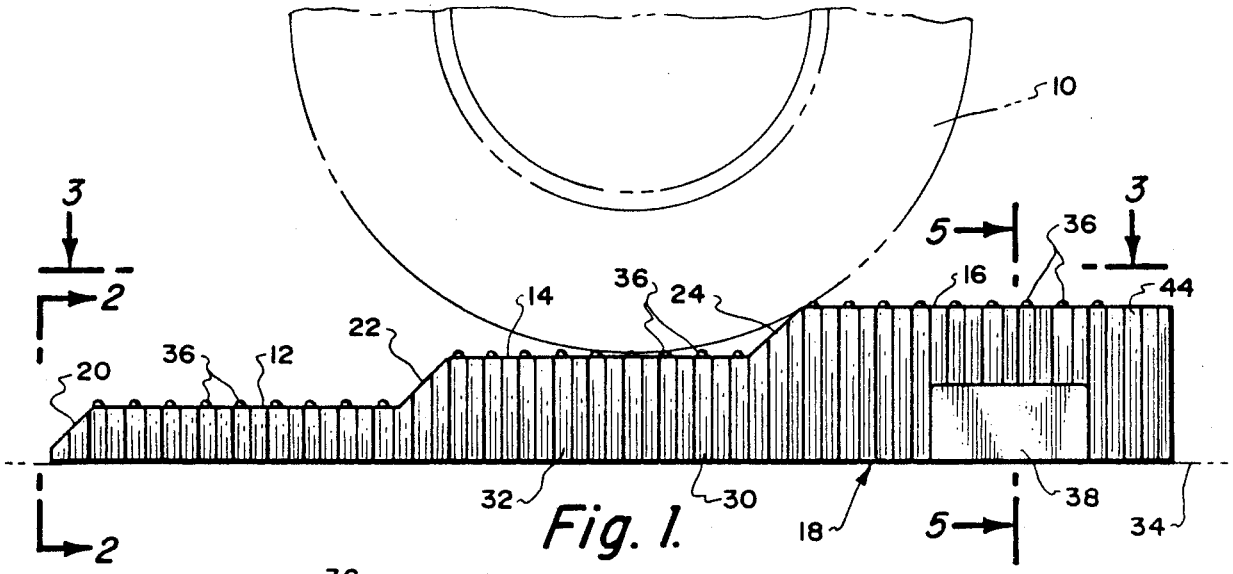
FIG. 1 is a side elevational view of the leveling device of the present invention showing a vehicle tire, in phantom, being associated with one of the levels of the device.
Figure 2:
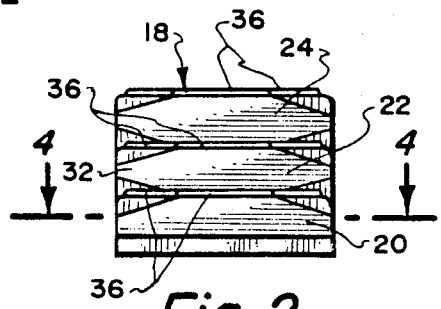
FIG. 2 is a front end view of the device of the present invention taken along line 2—2 of FIG. 1.
Figure 5:
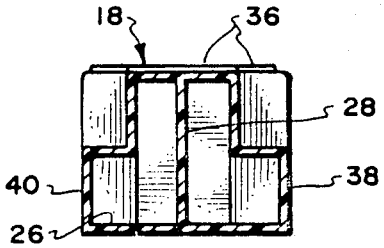
FIG. 5 is a lateral cross-sectional view through the device of this invention taken along line 5—5 of FIG. 1.

Referring particularly to FIG. 1 there is depicted a tire 10. It is to be assumed that this tire 10 is one of four tires on a vehicle. This tire 10 is to be locatable on either level 12, level 14 or level 16 of the vehicle leveling device 18 of this invention. Movement of the tire 10 onto level 12 is facilitated through the use inclined ramp 20 formed at the front edge of the device 18. A similar inclined ramp 22 is located between levels 12 and 14 with a still similar inclined ramp 24 being located between levels 14 and 16. For purposes of this description, the inclined ramps 20, 22 and 24 are not considered to be part of the upper surface of the device 18.

The body of the leveling device 18 is constructed of an integral molded plastic sheet material member being hollow forming an interior chamber 26. Within the interior chamber 26 there is located a sheet material, cross-brace arrangement 28. The cross-brace arrangement 28 is for the purpose of increasing the compressive strength of the device 18.

Also, it is to be noted that the side walls of the device 18 are profoundly corrugated forming a plurality of evenly spaced apart grooves 30 and a plurality of evenly spaced apart protrusions 32. It is the function of these grooves 30 and the protrusions 32 to again increase the compressive strength of the device 18. This compressive strength is necessary so as to be able to safely support the weight of the vehicle (not shown) of which the tire 10 is part. The tire 10 can be easily driven up onto inclined ramp 20 onto level 12 and if level 12 is not of sufficient height, the tire 10 can then be easily driven across inclined ramp 22 onto level 14. Still again, if there is not adequate height, the tire 10 is to be driven across inclined ramp 24 onto level 16. It is to be understood that maybe one tire 10 would be located on level 12 and another tire 10 would be located on level 14, and possible even a third tire be located on level 16. Normally, there will be at least one tire that will remain on the supporting surface 34.

In order to insure that there is no slipping of the tire 10 on each of the surfaces 12, 14 and 16, each of these surfaces include a plurality of spaced apart ridges 36. Each of the ridges 36 function in a manner to form in essence an anti-skid surface which is caused by making the levels 12, 14 and 16 having uneven surfaces. It is considered to be within the scope of this invention that each of the surface 12, 14 and 16 could be roughened in another manner such as by incorporating some type of sandpaper type of surface.

In molding of the device 18, it is desired that within each of the side walls there be formed short planar sections 38 and 40. It is the function of these short planar sections 38 and 40 to facilitate attachment of a nameplate or other similar type of identifying indicia.

By utilizing the strengthening corrugations forming grooves 30 and the cross-brace arrangement 28, a lightweight, high strength device 18 is achieved capable of supporting a substantial vehicle weight. The corrugations significantly increase the strength of device 18 so the device 18 can be manufactured of a minimum length.

Figure 3:
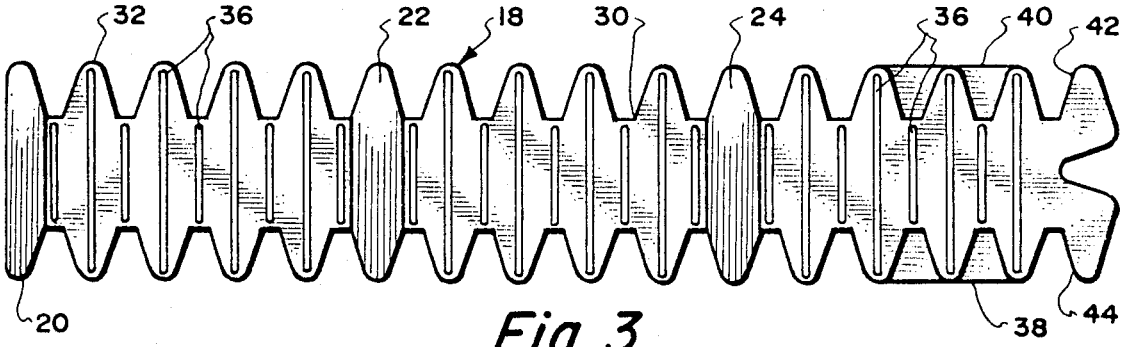
FIG. 3 is a top plan view of the device of the present invention taken along line 3—3 of FIG. 1.
Figure 4:
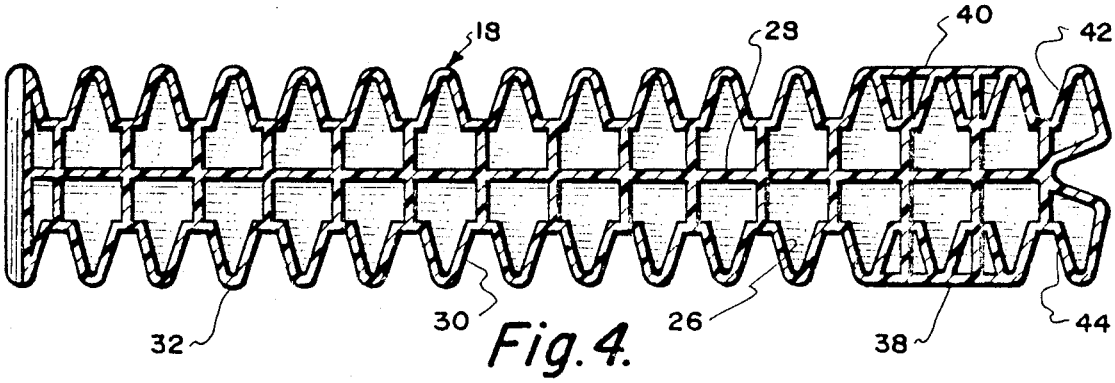
FIG. 4 is a cross-sectional view through the device of the present invention taken along line 4—4 of FIG. 2.

Grooves 42 and 44 are capable of interlocking with mating protrusions of an attachment (not shown). This attachment would provide for a further level, similar to levels 12, 14 and 16, but of a greater height than level 16. As is readily apparent in FIG. 3, all of the grooves 30 are of the size in transverse cross-section. Grooves 42 and 44 are also of the same size as grooves 30. This same size arrangement is of particular advantage during forming of the mold (not shown) to produce the device 18.

What is claimed is:

1. A structure leveling device comprising:

an integral plastic member having a bottom surface and an upper surface, said bottom surface to rest on a supporting surface, said upper surface being divided into a plurality of levels of different heights, a portion of said structure being adapted to rest on one of said levels, said integral plastic member being hollow and formed of sheet material, said integral plastic member having side walls, said side walls being formed into a continuous corrugated configuration thereby enhancing the overall compressive strength characteristic of said structure leveling device, said corrugated configuration defining a plurality of grooves, all of said grooves being of the same size in transverse cross-section;

said hollow forming an internal chamber, a cross-brace arrangement formed within said internal chamber to also enhance the overall compressive strength characteristic of said structure leveling device; and said integral plastic member having a front edge and a rear edge, said rear edge being greater in height than said front edge, locking means located directly adjacent said rear edge, said locking means being adapted to interconnect with a separate attachment providing a still further level of a different height, said locking means comprising a pair of said grooves with one of said groove being formed within one said side wall and the other said groove formed within the opposite said side wall.

* * * * *